United States Patent [19]

Butler

[11] 4,334,626

[45] Jun. 15, 1982

[54] DISCHARGE CONE ASSEMBLY FOR A ROTARY GRINDING MILL OR THE LIKE

[75] Inventor: William J. Butler, Duluth, Minn.

[73] Assignee: Vermillion Equipment & Supply Co., Inc., Hibbing, Minn.

[21] Appl. No.: 134,740

[22] Filed: Mar. 28, 1980

[51] Int. Cl.[3] ..... B02C 17/18

[52] U.S. Cl. ..... 241/171; 241/70

[58] Field of Search ..... 241/70, 71, 79.2, 79.3, 241/171, 179, 181

[56] References Cited

U.S. PATENT DOCUMENTS 3,599,882 8/1971 Sasaski et al. ..... 241/70

4,172,560 10/1979 Butler ..... 241/171

*Primary Examiner*—Mark Rosenbaum

*Assistant Examiner*—Timothy V. Eley

*Attorney, Agent, or Firm*—Wicks & Nemer

[57] ABSTRACT

Discharge cone assembly adapted to be mounted inside a rotary grinding mill or the like is disclosed, in the preferred embodiment, including first and second holders, first and second wearable inserts, first and second cover plates, a wearable nosepiece, and first and second securing plates. The rotary grinding mill includes discharge assemblies having discharge chambers. The ground material from the mill flows into the discharge chambers through grates formed in the discharge assemblies. The holders are permanently mounted in the mill for receiving the wearable inserts. The preferred inserts are captured within the holders by the cover plates and are in ground material communication with the discharge chambers of the discharge assemblies. The nosepiece is in ground material communication with the first and second inserts and provides a unitary outlet therefore. The nosepiece is secured to the holders and the inserts by studs formed on lips projecting from the holders which are received in apertures formed in the nosepiece and by securing the securing plates to the nosepiece and to the holders and the inserts. The nosepiece is separately removable and replaceable without removing the holders, the inserts, or the cover plates by removing the securing plates and raising the nosepiece so that the studs of the lips on the holders do not extend into the apertures of the nosepiece.

23 Claims, 6 Drawing Figures

DISCHARGE CONE ASSEMBLY FOR A ROTARY GRINDING MILL OR THE LIKE

BACKGROUND

The present invention relates generally to discharge cone assemblies, and specifically to discharge cone assemblies for the discharge end of rotary grinding mills or the like.

It is well known that the discharge end of a rotary grinding mill or the like, such as shown in U.S. Pat. No. 3,599,882, is subjected to extreme abrasive wear due to the ground material passing therethrough. Discharge diaphragm assemblies formed of discharge castings, grates, and wear plates, as in U.S. Pat. No. 3,599,882, are used in grinding mills in an attempt to maximize the useful lives of the mills. However, it is necessary to form the discharge diaphragm assemblies out of very expensive material such as Ni-Hard iron. Furthermore, the discharge diaphragm assembly of the prior art, after being worn by the ground material had to be removed and replaced piece by piece, which is expensive in both labor and also down time in that the grinding mill cannot be operated for significant periods during replacement of the discharge diaphragm assembly.

U.S. Pat. No. 4,172,560, by the present inventor, provides a replaceable liner for insertion into the discharge castings of existing mills. Such replaceable liners can be inexpensively replaced with substantial savings in labor and down time and also allow the discharge diaphragm assemblies to be made of less costly material.

However, the discharge cones of rotary grinding mills are yet subjected to excessive wear. Thus, a need yet exists for an improved discharge cone assembly which allows replacement of the excessive wear locations with reduced expenditure of labor and down time, which has a longer wear life than discharge cones of the prior art, and which is not prone to allowing ground material escape back into the mill and thus decrease the mill efficiency.

SUMMARY

The present invention solves these and other problems in rotary grinding mills or the like by providing, in the preferred embodiment, an improved discharge cone assembly consisting of first, second, and third members. The first and second members include discharge passageways in ground material communication with the discharge assemblies of the rotary grinding mill. The third member is in ground material communication with the discharge passageways of the first and second members and provides a unitary outlet of the ground material therefrom. The first and second members are secured in the mill and the third member is secured to the first and second members allowing removal of the third member from the mill without removing the first and second members.

It is thus an object of the present invention to provide a discharge cone assembly for a rotary grinding mill or the like.

It is a further object of the present invention to provide such a novel discharge cone assembly which can be partially and inexpensively replaced within the rotary grinding mill with substantial savings in labor and down time.

It is a further object of the present invention to provide such a novel discharge cone assembly which may be manufactured at a low cost and which tends to maximize wear before replacement.

It is a further object of the present invention to provide such a novel discharge cone assembly which does not allow the ground material to escape back into the mill and thus decrease the mill efficiency.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
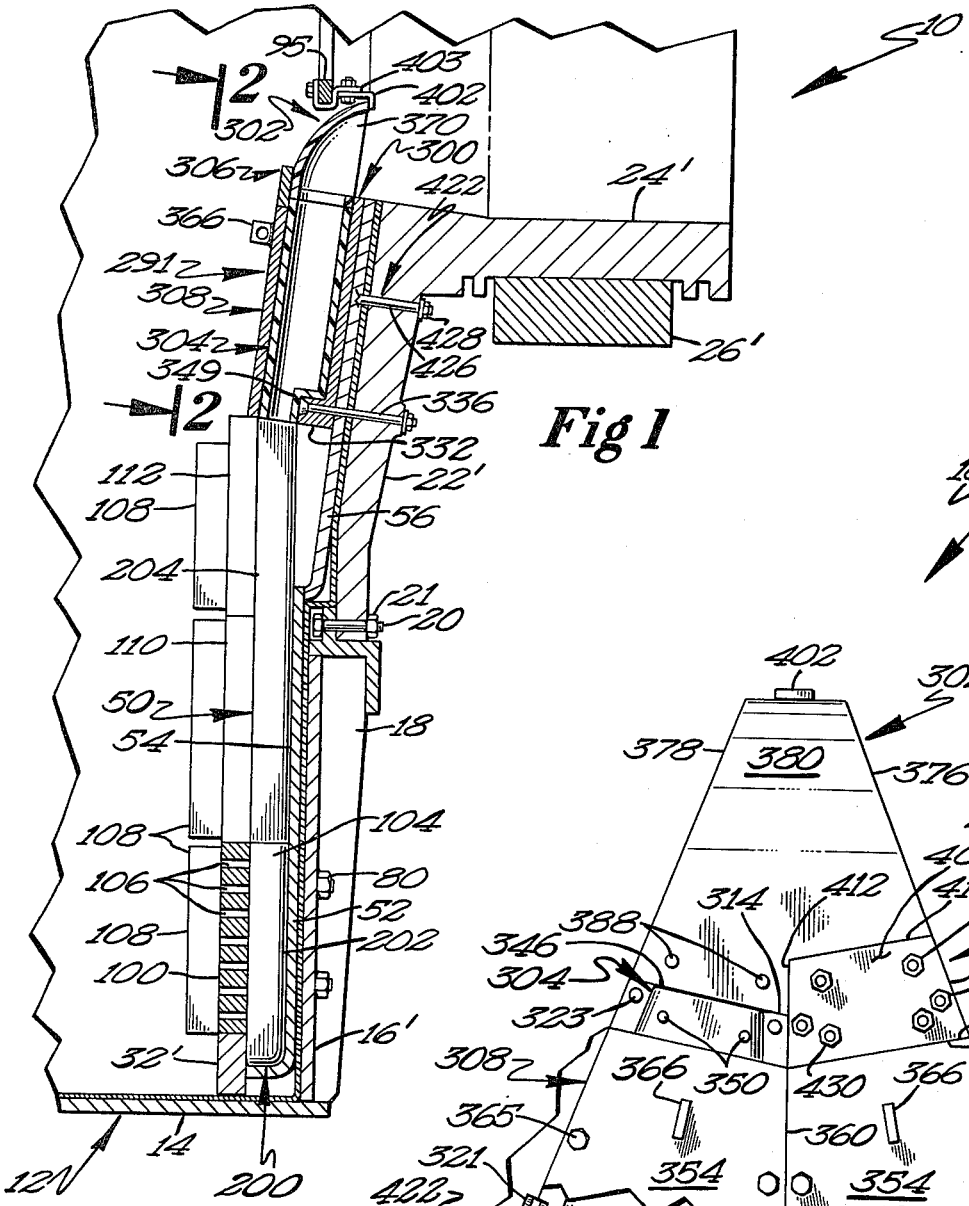
FIG. 1 shows a partial longitudinal section of a grinding mill having a discharge cone assembly according to the teachings of the present invention.

All figures are drawn for ease of explanation of the basic teachings of the present invention only; the extensions of the figures with respect to number, position, relationship, and dimensions of the parts to form the preferred embodiment will be explained or will be obvious from the explanation given.

Where used in the various figures of the drawings, the same numeral designates the same or similar parts in the present invention. Furthermore, when the terms "right", "left", "first", "second", "top", "bottom", and similar terms are used herein, it should be understood that these terms have reference only to the structure shown in the drawings as it would appear to a person viewing the drawings and are utilized only to facilitate describing the invention.

DESCRIPTION

Figure 2:
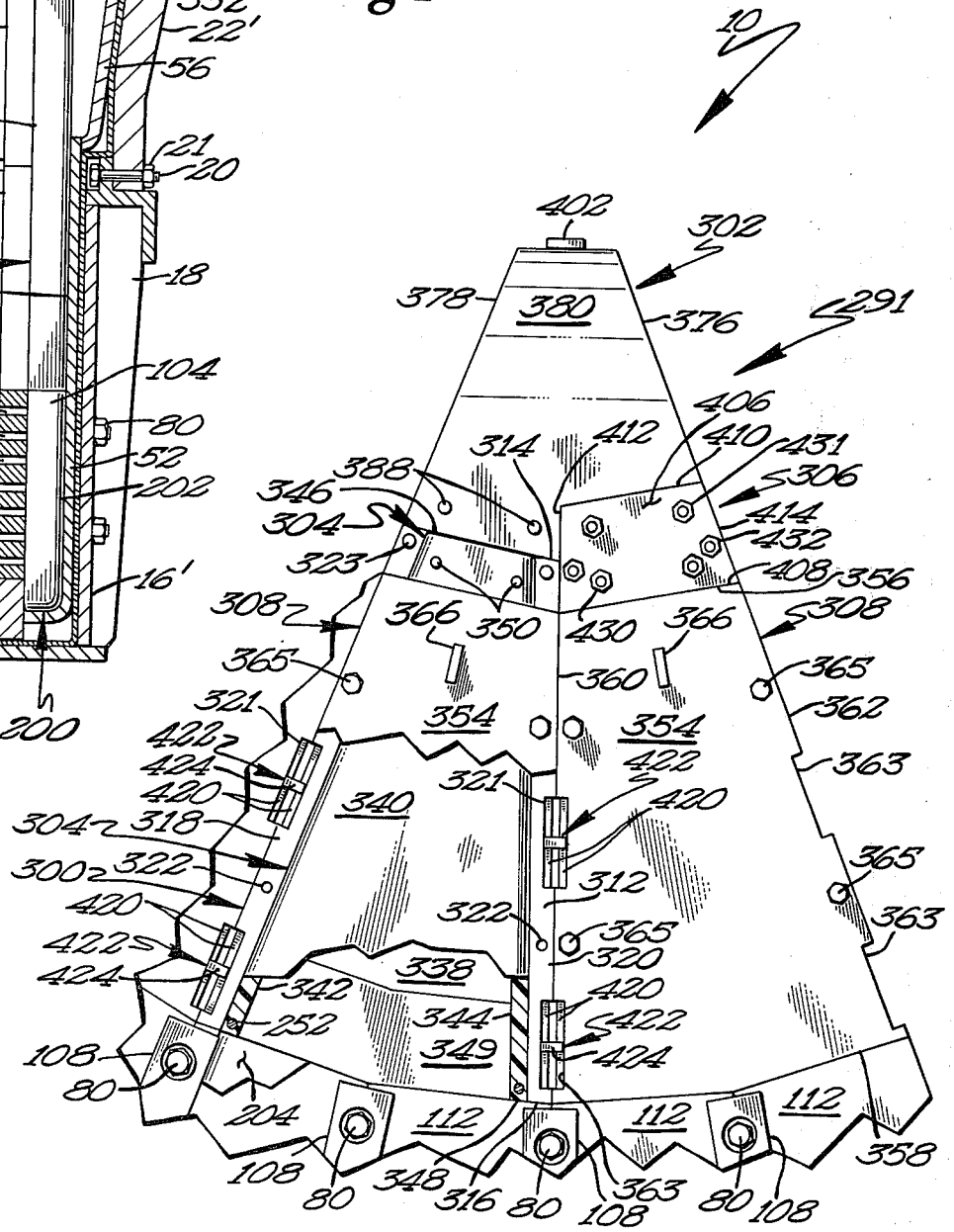
FIG. 2 is a side view of the mill of FIG. 1 according to view line 2—2 of FIG. 1, with portions of the mill broken away.
Figure 3:
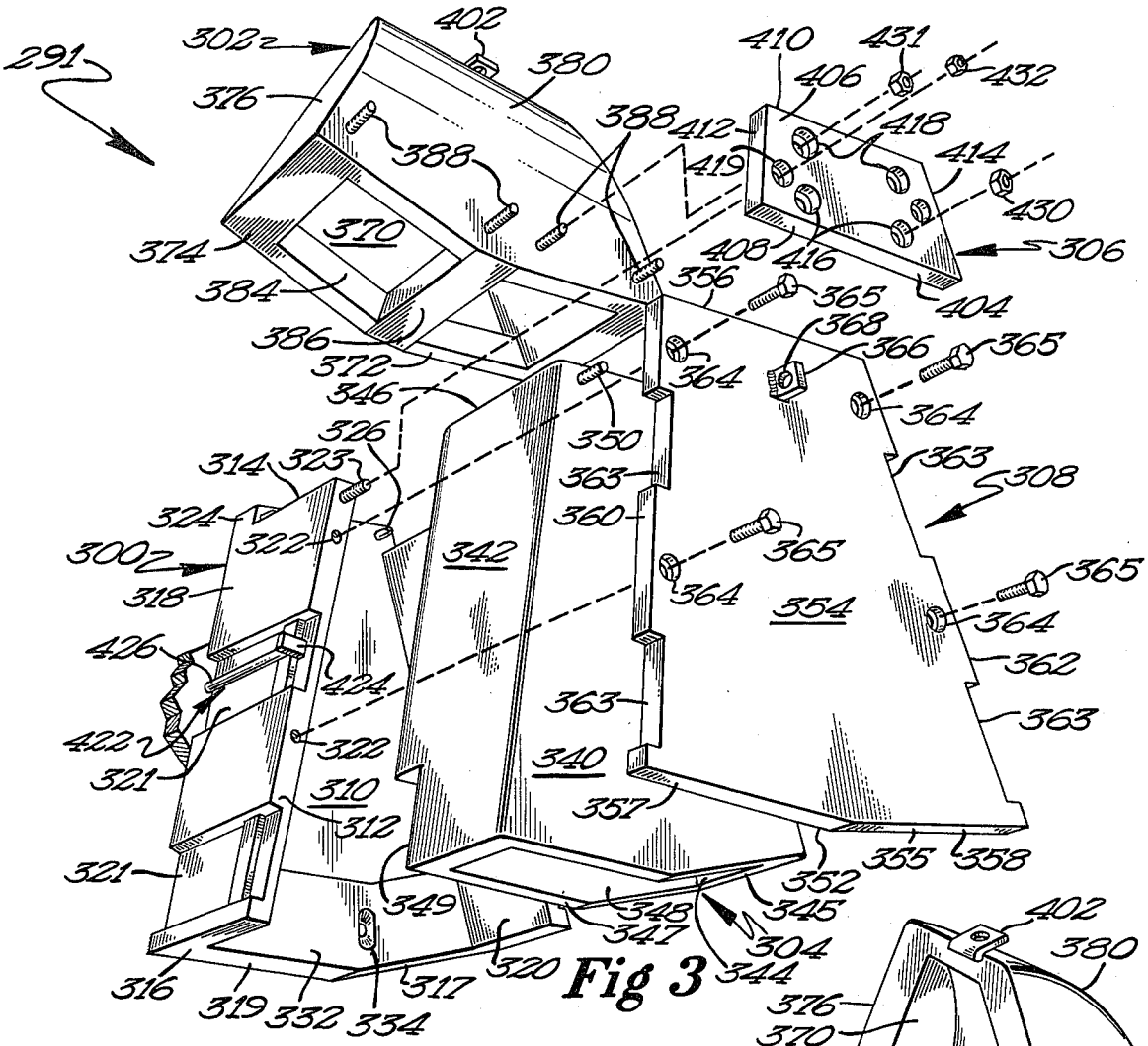
FIG. 3 is an exploded perspective view of the discharge cone assembly of FIG. 1.
Figure 5:
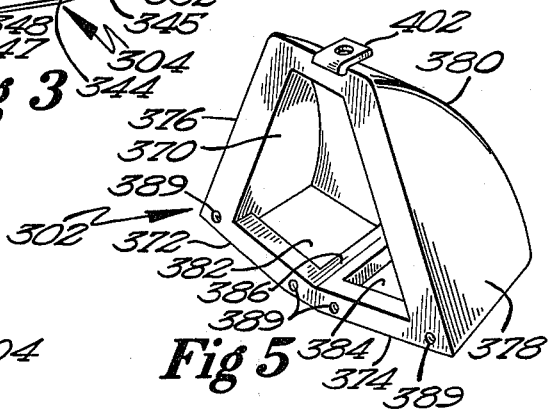
FIG. 5 is a perspective view of the nosepiece of the discharge cone assembly of FIG. 1.
Figure 4:
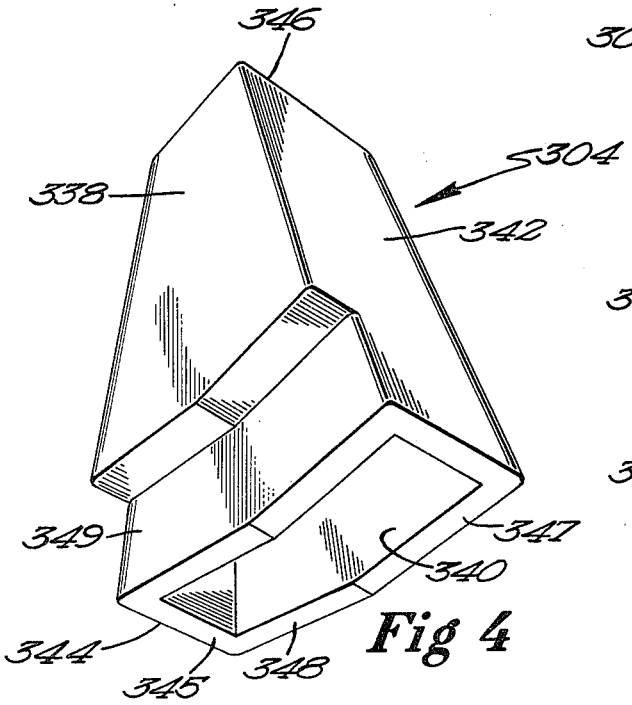
FIG. 4 is a perspective view of the wearable insert of the discharge cone assembly of FIG. 1.

An improved discharge cone assembly for a rotary grinding mill or the like is shown in the figures and generally designated 291. Referring to FIGS. 1 and 2, the rotary grinding mill or the like is generally designated 10 and may be of the type as diagrammatically shown in U.S. Pat. No. 3,599,882. Mill 10 includes a shell generally indicated at 12 comprising a cylindrical shell plate 14 which is rigidly attached to shell flanges 16'. Shell flanges 16' have ribs 18 rigidly secured thereto or integral therewith. As seen in FIG. 1, shell flange 16' is rigidly secured as by bolts 20 and nuts 21 to the end plate or heat 22' which is integral with the trunnion 24' upon which the mill 10 is supported for rotation by bearing 26'. Trunnion 24' is hollow and serves as the discharge trunnion of the grinding mill 10.

Mill 10 is provided with a discharge assembly 50 including a plurality of superposed tiers of outer discharge castings 52, middle or intermediate discharge castings 54, and inner discharge castings 56, and a discharge cone shown in the preferred embodiment as assembly 291 of the present invention. Castings 52, 54, 56, and assembly 291 are contiguous and extend circumferentially of mill 10. Further included are grates 100 provided with passages 106 therethrough of appropriate size, and wear plates 110 and 112. Bolts 80 pass through lifter bar 108 for attaching grate 100 to casting 52 and both to shell 16'. Similarly, wear plates 110 and 112 are attached to castings 54 and 56 and to shell 16' and heat 22', respectively. Castings 52, 54, and 56, grate 100, and plates 110 and 112 define a discharge chamber 104. The radially outer edge surfaces of grate 100 abut against the radially inner surface of a filler ring 32'. Mill 10 further includes a retainer ring 95 for providing supplemental radial retaining action preventing radial movement of the discharge cone assembly 291 as will be explained further hereinafter.

In the preferred embodiment, castings 52, 54, and 56 include replaceable liners 200 having at least a first box member 202 and a second box member 204 of the type disclosed in application Ser. No. 886,092 filed on Mar. 13, 1978 by the same inventor, now U.S. Pat. No. 4,172,560, the disclosure of which is incorporated herein by reference.

Specifically, assembly 291 according to the teachings of the present invention includes first and second permanent holders 300, a wearable, replaceable nosepiece 302, first and second wearable, replaceable box inserts 304, first and second permanent securing plates 306, and first and second permanent covering plates 308.

Holder 300 may be constructed of a metallic substance such as fabricated mild steel and is intended to be installed permanently inside mill 10. Holder 300 includes a closed bottom 310, an open top 312, a first open end 314, a second open end 316, a first closed side 318, and a second closed side 320. Open end 316 is formed by the intersection of a first open plane 317 and a second open plane 319 which intersect at an angle located along the center of end 316. Holder 300 has a shape complementary to and for receipt in the discharge cone portion of mill 10, as best seen in FIG. 2, and in the preferred embodiment is wedge shaped. In other words, sides 318 and 320 of holder 300 taper towards each other from end 316 to end 314 to fit the wedge shaped volume of the discharge cone portion of mill 10. The interior surfaces of sides 318 and 320 are smooth while the exterior surfaces of sides 318 and 320 have rectangular depressions 321. The top ends of sides 318 and 320 include first and second upstanding threaded studs 323 adjacent open end 314 and top 312 and a plurality of threaded apertures 322 adjacent open top 312. Bottom 310 includes a lip 324 projecting beyond sides 318 and 320 past open end 314. Lip 324 includes first and second studs 326 which upstand from lip 324 generally parallel to open end 314 and spaced from open end 314. Lip 324 may further include a tab, not shown, having an aperture therethrough, which projects in a direction generally parallel to lip 324 and away from end 314 allowing for the attachment of a chain of a lifting device when holder 300 is installed in mill 10. Holder 300 further includes a plate 332 attached to bottom 310 and sides 318 and 320 adjacent to end 316 and having a boomerang shape corresponding to end 316. An aperture 334 is formed in the center of plate 332 for receipt of a bolt 336 for attaching holder 300 to heat 22' of mill 10.

Box insert 304 has a shape complementary to and for receipt in the interior of holder 300. Box insert 304 is constructed in a similar manner as second box member 204 of U.S. Pat. No. 4,172,560 and similarly includes reinforcing members 252 of the type shown in U.S. Pat. No. 4,172,560, the disclosure thereof found in U.S. Pat. No. 4,172,560 is incorporated herein by reference. Box insert 304 includes a closed bottom 338, a closed top 340, a first closed side 342, a second closed side 344, a first open end 346, and a second open end 348. Bottom 338, top 340, and sides 342 and 344 then define the interior of insert 304 or the ground material discharge passageway. In a similar manner as end 316 of holder 300, end 348 is formed by the intersection of a first open plane 345 and a second open plane 347 which intersect at an angle located along the center of end 348. Box insert 304 generally includes a boomerang shaped stair step 349 formed in bottom 338, sides 342 and 344, and end 348 corresponding to end 348 and complimentary to plate 342 of holder 300. Box insert 304 further includes first and second threaded studs 350 which upstand from top 340 adjacent end 346.

Cover or plate 308 may also be constructed of a metallic substance such as fabricated mild steel and includes a bottom surface 352, a top surface 354, a first end edge 356, a second end edge 358, a first side edge 360, and a second side edge 362. Side edges 360 and 362 may include depressions 363 and have shapes corresponding to sides 342 and 344 of holder 300, however, the length between end edges 356 and 358 of plate 308 is less than the length between ends 314 and 316 of holder 300. In a similar manner as end 316 of holder 300 and end 348 of insert 304, end 358 is formed by the intersection of a first surface 355 and a second surface 357 which intersect at an angle located along the center of end 358. Cover plate 308 includes apertures 364 corresponding to and for receipt of bolts 365 threadably received in apertures 322 of holder 300 for securing plate 308 to holder 300. A tab 366 including an aperture 368 upstands from plate 308 allowing for the attachment of a chain of a lifting device when plate 308 is installed to holder 300 in mill 10. It should then be noted that cover plate 308 has a shape complementary to and for receipt upon holder 300 such that end edge of 358 of cover 308 is flush with end 316 of holder 300 but end edge 356 of cover 308 is spaced from end 318 of holder 300.

Nosepiece 302 should be formed of material which has high resistance to abrasion allowing long wear life and which leads to easy replacement. In the preferred embodiment, nosepiece 302 is made of urethane in a similar manner as are box members 202 and 204 of U.S. Pat. No. 4,172,560 and insert 304.

Nosepiece 302 includes a discharge opening 370 having a pentagonal shape for discharging ground material from the interior of nosepiece 302. Nosepiece 302 includes a first end 372, a second adjacent end 374, a first side 376, and a second side 378 which upstand from opening 370. Nosepiece 302 further includes a curved member 380 which extends from the side of opening 370 opposite adjacent ends 372 and 374 and terminates in ends 372 and 374 and forms a closed end and top. Ends 372 and 374 and sides 376 and 378 are attached to and terminate in member 380. The angle between ends 372 and 374 is obtuse and in a preferred embodiment is equal to approximately 158 degrees. The angle between end 372 and side 376 and the angle between end 374 and side 378 are equal and are less than 90° and in the preferred embodiment are equal to approximately 79°. Adjacent to opening 370, the angle between side 376 and member 380 and the angle between side 378 and member 380 are equal and are greater than 90° and in the preferred embodiment are equal to approximately 113°.

Ends 372 and 374 include apertures 382 and 384, respectively, formed therein symmetrically about junction 386 of adjacent ends 372 and 374. Studs 388 extend from member 380 adjacent to and parallel to ends 372 and 374. Apertures 389 are formed in ends 372 and 374 adjacent opening 370 corresponding to and for receipt of studs 326 of holder 300.

Figure 6:
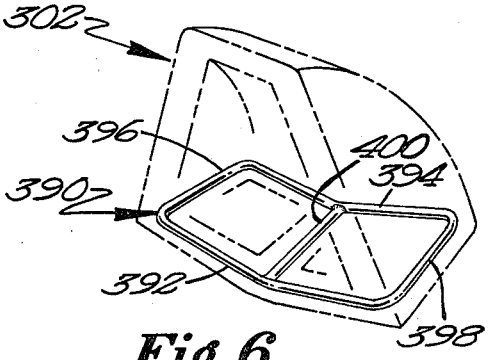
FIG. 6 is a perspective view of a reinforcing member of the nosepiece for the discharge cone assembly of FIG. 1, with the nosepiece being shown in phantom.

As best seen in FIG. 6, nosepiece 302 further includes a reinforcing member 390 embedded therein having a generally figure 8 shape. Reinforcing member 390 includes a first, bottom member 392 located in ends 372 and 374 adjacent to opening 370, a second, top member 394 located in ends 372 and 374 adjacent to member 380, a first, end member 396 located in first side 376 and attached between members 392 and 394, a second, end member 398 located in second side 378 and attached between members 392 and 394, and a third, middle member 400 located in the material at junction 386 of ends 372 and 374 and attached between members 392 and 394. Members 392 and 394 are V-shaped corresponding to the angle between ends 372 and 374 such that reinforcing member 390 is wedge shaped. Nosepiece 302 further includes a hook member 402 for attachment to ring 95 by a J-shaped member 403, as best seen in FIG. 1.

Plate 306 is constructed of a metallic substance such as fabricated mild steel and includes a bottom surface 404, a top surface 406, a first end edge 408, a second end edge 410, a first side edge 412, and a second side edge 414. Plate 306 includes apertures 416 corresponding to and for receipt of studs 350 of insert 304, apertures 418 corresponding to and for receipt of studs 388 of nosepiece 302, and apertures 419 corresponding to and for receipt of studs 323 of holder 300.

For securing or attaching holder 300 to heat 22′ of mill 10, shoulders 420 are provided in depressions 321 of sides 318 and 320. Shoulders 420 on adjacent holders 300 in adjacent tiers of discharge castings of mill 10 abut together and form a receptacle for T-shaped bolts 422. Bolts 422 include a non-wedged shaped head 424, shown as being rectangular in shape, a shaft 426, and a nut 428 threadably attached to shaft 426. Head 424 abuts with shoulders 420 of adjacent holders 300 and shaft 426 extends through depressions 321 of adjacent holders 300 and through heat 22′. Thus, each bolt 422 attaches two holders 300 to heat 22′ of mill 10.

It should be noted that the wedge bolts of the type disclosed in U.S. Pat. No. 3,599,882 used to attach the cone castings may wedge or push the free ends of sides 318 and 320 together due to the open top 312 of holder 300 being located in the interior of mill 10, which does not occur in the cone castings having a closed top and sides of the type of U.S. Pat. No. 3,599,882. Thus, due to the rectangular shape of head 424, rather than the wedge shape of the bolts of U.S. Pat. No. 3,599,882, wedging of sides 318 and 320 does not occur when using bolts 422 and the complementary shoulders 420 of the present invention.

At least first and second holders 300 are then installed in mill 10 by the use of a lifting device which is removably attached to the tab, not shown, extending from lip 324. When holders 300 are in the correct possession in mill 10, bolts 422 can be inserted in shoulders 420 of depressions 321 and bolt 336 is inserted in aperture 334 of plate 332 through heat 22′ and secured thereto by tightening nuts thereon.

After holders 300 have been installed in mill 10, insert 304 can be placed within the interior of each holder 300. Plates 308 can then be placed upon holders 300 such that bottom 352 of plate 308 rests on and is supported by sides 318 and 320 of holder 300. Bolts 365 are then passed through apertures 364 and threadably secured in apertures 322 to secure plate 308 to holder 300 and thus close open top 312 of holder 300 and capture insert 304 within the interior of holder 300. Open end 348 of insert 304 is then in ground material communication with discharge chamber 104 of two discharge assemblies consisting of castings 52, 54, and 56 which abut with planes 317 and 319 of holder 300, planes 345 and 347 of insert 304, and surfaces 355 and 357 of plate 308. Studs 350 of insert 304 and a portion of insert 304 is exposed beyond end 356 of cover plate 308.

At that time, nosepiece 302 is positioned in mill 10 such that studs 326 of holders 300 are placed within apertures 389 of nosepiece 302 and open end 346 of insert 304 aligns with aperture 382 of nosepiece 302 and is in ground material communication therewith and open end 346 of another insert 304 aligns with aperture 384 of nosepiece 302 and is in ground material communication therewith. Plates 306 can then be placed upon holders 300, nosepiece 302, and inserts 304 such that bottom 404 rests on and is supported by sides 318 and 320 of holder 300, top 340 of insert 304 which is exposed beyond end 356 of plate 308, and member 380 of nosepiece 302 and such that studs 350 of insert 304 pass through apertures 416 of plate 306, studs 388 of nosepiece 302 pass through apertures 418 of plate 306, and studs 323 of holder 300 pass through apertures 419 of plate 306. Edge 356 of cover 308 abuts against and is adjacent to edge 408 of cover 306. Suitable nuts 430, 431, and 432 or other fastening devices can be attached to studs 350 of insert 304, studs 388 of nosepiece 302, and studs 323 of holder 300, respectively, to secure plate 306 to nosepiece 302, insert 304, and holder 300. Thus, nosepiece 302 is secured to insert 304 and holder 300 in the discharge assembly by studs 326 received within apertures 389, studs 388 received within apertures 418, studs 350 received within apertures 416, and studs 323 received within apertures 419. To prevent radial movement of discharge cone assembly 291, member 403 is attached to hook member 402 and to ring 95, such as by bolts as shown.

Thus, discharge cone assembly 291 according to the teachings of the present invention includes three major components or members. Specifically, a first member consisting of a first holder 300, a first insert 304, and a first plate 308 having a discharge passageway in ground material communication with two discharge assemblies and with opening 382 of nosepiece 302; a second member consisting of a second holder 300, a second insert 304, and a second plate 308 having a discharge passageway in ground material communication with two discharge assemblies and with opening 384 of nosepiece 302; and a third member consisting of nosepiece 302.

Although tab 366 extends into the interior of mill 10, it has been found that due to its close proximity to the center of mill 10, no negative results occur and therefore tab 366 can be left on plate 308 such that it can be utilized whenever it is necessary to remove plate 308 to replace insert 304.

Stair step 349 of box insert 304 conforms to plate 332 of holder 300 and is used to match up with the construction of mill 10. However, stair step 349 provides a further function of preventing backwash of the ground material. Backwash occurs when not all of the ground material discharges through opening 370 while the discharge chute is located in its discharge portion of the mill rotation and thus flows down the discharge assembly in the opposite direction when the discharge chute is located in its grinding/inlet portion of the mill rotation. Backwash thus decreases the mill's efficiency and also increases wear of the discharge assembly. Specifically, the ground material falls down the discharge assembly with a large force hitting the closed end of the outer casting 52 causing excessive wear thereto. Stair step 349 prevents backwash since the ground material falls on and is held in place by stair step 349 rather than flow back to the inlet of the discharge assembly as occurs in mills prior to the present invention which include an incline having a smooth interior surface.

In mills prior to the present invention, adjacent discharge castings forming the discharge cone formed one half of the discharge outlet. Specifically, the top of the discharge castings curved downward and one of the sides extended into and terminated in the top. In the mill, adjacent discharge castings had alternate sides terminating in the top such that a unitary discharge outlet was formed by adjacent castings. Thus, a gap may have been left between the tops of the adjacent discharge castings forming the discharge cone in the mill which form the unitary outlet in the mill. This gap allowed finely ground material which should have been exiting the mill through the discharge outlet to leak back to the mill, thereby decreasing the efficiency of the grinding mill. In the present invention, discharge cone assembly 291, rather than include two major components as in the prior art, includes three major components, with nosepiece 302 formed from a unitary member and thus not having or allowing a gap as could occur using discharge castings of the prior art including those of the type of U.S. Pat. No. 3,599,882.

Additionally, when the ground material has worn through any portion of the discharge casting, it is necessary to remove the entire piece of the discharge casting for replacement. It should then also be noted that the area around the discharge outlet is a high wearing area. Particularly, the curved portion of the discharge castings forming the discharge cone is subjected to excessive wear. Thus, when this curved portion was worn through, prior to the present invention, it was necessary to replace the entire discharge casting. With the discharge cone assembly 291 of the present invention, it is only necessary to replace nosepiece 302 which includes the high wear locations, and it is only necessary to replace insert 304 when it is worn. This is a particular advantage of this embodiment of the present invention. Further, in the preferred embodiment, nosepiece 302 is formed of urethane at greatly reduced cost over the material such as Ni-Hard iron used in the castings forming the discharge cone of prior mills. Additionally, since nosepiece 302 includes high wear locations, the walls forming piece 302 can be formed of greater thickness than the walls of insert 304 such that nosepiece 302 has a longer useful life while maintaining costs at a minimum.

Further, an additional advantage of assembly 291 of the present invention is that nosepiece 302 can be removed and replaced by itself simply by removing plate 306 and member 403. This is another particular advantage of this embodiment of the present invention.

Thus, due to the one piece construction of nosepiece 302 and the novel construction allowing the easy replacement of nosepiece 302, the present invention greatly reduces costs by saving material in that only the excessive wear pieces are removed, i.e. nosepiece 302, the labor necessary to change the nosepiece 302 is considerably less than replacing the discharge cone of prior mills, and most importantly the down time of mill 10 is greatly reduced. Further, since the discharge cone assembly 291 of the present invention is formed from multiple pieces rather than a single piece, assembly 291 is easier to handle because of the reduced size and weight of the components. For example, the weight of holder 300 is 1600 pounds and the weight of plate 308 is 800 pounds in the preferred embodiment.

Furthermore, nosepiece 302 and insert 304 can be removed as a unit from mill 10 and holders 300 by removing plates 308 and by detaching burrs 432 from studs 323 of holders 300 in addition to detaching member 403 from hook member 402 and without removing holders 300. Insert 304 can be removed from mill 10 and holder 300 by removing plates 306 and 308 and without removing holders 300 or nosepiece 302.

Since plate 308 includes depressions 363 in side edges 360 and 362 and corresponding to depressions 321 of sides 318 and 320 of holder 300, holders 300 can be secured or unsecured to mill 10 without removing plate 308 by passing bolt 422 through depressions 363 formed in adjacent plates 308. It should be noted that the nut on bolt 336 must also be threadably attached or removed before holder 300 can be secured or unsecured from mill 10. If this feature is not desired, depressions 363 may be omitted from side edges 360 and 362 such that adjacent plates 308 in mill 10 cover and protect bolt 422 and shoulders 420.

Please further note that if reinforcing member 390 were not present in nosepiece 302, nosepiece 302 could have a tendency to wrinkle and be discharged out of the discharge outlet. However, due to the existence and particular configuration of reinforcing member 390, nosepiece 302 is given additional rigidity to prevent wrinkling. Further, due to the wedge shape of reinforcing member 390, nosepiece 302 is further prevented from being discharged out of the discharge outlet because nosepiece 302, as a result of the particular configuration of the reinforcing member 390, wedges itself within the discharge casting.

Now that the basic teachings of the present invention have been explained, it can be appreciated that the discharge cone 291 according to the teachings of the present invention allows substantial savings in both costs of materials and installation labor, especially when used in conjunction with box members 202 and 204 as disclosed herein and in U.S. Pat. No. 4,172,560. It should be noted that using the teachings of the present invention, some or all of the components of assembly 291 can be made of Ni-Hard iron if features of the wearable, replaceable liners are not desired.

Thus, since the invention disclosed herein may be embodied in other specific forms without departing from the spirit or general characteristics thereof, some of which forms have been indicated, the embodiments described herein are to be considered in all respects illustrative and not restrictive. The scope of the invention is indicated by the appended claims, rather than by the foregoing description, and all changes which come within the meaning and range of equivalency of the claims are intended to be embraced therein.

What is claimed is:

1. A discharge cone assembly adapted to be mounted inside a rotary grinding mill or the like, with the mill including at least first and second discharge assemblies, with the discharge assemblies including a discharge chamber and a grate for allowing access for the ground material in the interior of the mill into the discharge chamber, comprising, in combination: a first member including a discharge passageway having a first open end and a second open end, with the second open end of the first member being in ground material communication with the discharge chamber of the first discharge assembly; a second member including a discharge passageway having a first open end and a second open end, with the second open end of the second member being in ground material communication with the discharge chamber of the second discharge assembly; means for securing the first and second members in the mill; a third member comprising a nosepiece including an interior, a first end having a first opening, a second end having a second opening, and an open unitary outlet, with the first open end of the first member being in ground material communication with the first opening of the nosepiece, with the first open end of the second member being in ground material communication with the second opening of the nosepiece, with the unitary outlet discharging the ground material from the interior of the nosepiece out of the mill; and means for securing the nosepiece to the first and second members allowing removal of the nosepiece from the mill without unsecuring or removal of the first and second members from the mill.

2. The discharge cone assembly of claim 1 wherein the nosepiece securing means includes a first lip projecting from the first member past the first open end of the first member; a second lip projecting from the second member past the first open end of the second member; at least a first stud projecting from the first lip; at least a second stud projecting from the second lip; means formed in the nosepiece adjacent the first end for receiving the first stud; and means formed in the nosepiece adjacent the second end for receiving the second stud.

3. The discharge cone assembly of claim 1 or 2 wherein the nosepiece securing means includes a first plate; a second plate; means for securing the first plate to the nosepiece and the first member; and means for securing the second plate to the nosepiece and the second member.

4. The discharge cone assembly of claim 1 wherein the unitary outlet of the nosepiece has a pentagonal shape, wherein the first and second ends of the nosepiece are adjacent and upstand from the unitary outlet of the nosepiece, and wherein the nosepiece further includes a first closed side and a second closed side which upstand from the unitary outlet of the nosepiece, and a curved member which extends from the side of the unitary outlet of the nosepiece opposite the first and second ends of the nosepiece and terminates in the first and second ends of the nosepiece and forms a closed end and top, with the first and second sides of the nosepiece being attached to and terminating in the curved member.

5. The discharge cone assembly of claim 4 wherein the nosepiece is formed of urethane.

6. The discharge cone assembly of claim 5 wherein the nosepiece includes a reinforcing member embedded therein to aid in preventing the nosepiece from wrinkling in the mill and being discharged therefrom.

7. The discharge cone assembly of claim 6 wherein the nosepiece includes a junction formed between the first and second openings of the first and second ends of the nosepiece, and wherein the reinforcing member comprises, in combination: a first, bottom member located in the first and second ends of the nosepiece adjacent to the unitary outlet of the nosepiece, a second, top member located in the first and second ends of the nosepiece adjacent to the curved member of the nosepiece, a first, end member located in the first side of the nosepiece and attached between the first, bottom member and the second, top member, a second, end member located in the second side of the nosepiece and attached between the first, bottom member and the second, top member, and a third, middle member located in the junction of the nosepiece and attached between the first, bottom member and the second, top member.

8. The discharge cone assembly of claim 7 wherein the first, bottom member and the second, top member of the reinforcing member are V-shaped such that the reinforcing member is wedged shaped.

9. The discharge cone assembly of claim 1 or 4 wherein the first member comprises, in combination: a first holder having a first open end, a second open end, an open top, a closed bottom, a first closed side, and a second closed side, a first wearing insert for insertion within the first holder through the open top, with the first insert including the discharge passageway and the first and second open ends of the first member, and a first cover for closing the open top of the first holder and for capturing the first insert within the first holder; wherein the second member comprises, in combination: a second holder having a first open end, a second, open end, an open top, a closed bottom, a first closed side, and a second closed side, a second wearing insert for insertion within the second holder through the open top, with the second insert including the discharge passageway and the first and second open ends of the second member, and a second cover for closing the open top of the second holder and for capturing the second insert within the second holder; and wherein the first and second member securing means comprises means for securing the first and second holders in the mill with the open tops thereof being located in the interior of the mill allowing removal of the first and second inserts by removing the first and second covers from the first and second holders without removing the first and second holders from the mill.

10. The discharge cone assembly of claim 9 wherein the first and second holder securing means comprises, in combination: depressions formed in the exterior surfaces of the first and second sides of the first and second holders; a T-shaped bolt having a non-wedged shaped head; shoulders formed in the depressions which create a receptacle for the head of the T-shaped bolt when the depressions of the first and second holders are placed adjacent to each other such that the T-shaped bolt can abut within the receptacle without wedging the first and second sides of the first and second holders together.

11. The discharge cone assembly of claim 10 wherein the first and second covers include depressions corresponding to the depressions formed in the first and second holders allowing the securement or unsecurement of the first and second holders from the mill without removing the first and second covers from the first and second holders by passing the T-shaped bolts through the depressions formed in the first and second covers.

12. The discharge cone assembly of claim 9 wherein the nosepiece securing means includes a first lip projecting from the first holder past the first open end of the first holder; a second lip projecting from the second holder past the first open end of the second holder; at least a first stud projecting from the first lip; at least a second stud projecting from the second lip; means formed in the nosepiece adjacent the first end for receiving the first stud; and means formed in the nosepiece adjacent the second end for receiving the second stud.

13. The discharge cone assembly of claim 12 wherein the nosepiece securing means includes a first plate; a second plate; means for securing the first plate to the nosepiece and the first holder; and means for securing the second plate to the nosepiece and the second holder.

14. The discharge cone assembly of claim 13 wherein the nosepiece securing means further includes means for securing the first plate to the first insert; and means for securing the second plate to the second insert.

15. The discharge cone assembly of claim 9 wherein the nosepiece securing means includes a first plate; a second plate; means for securing the first plate to the nosepiece and the first holder; and means for securing the second plate to the nosepiece and the second holder.

16. The discharge cone assembly of claim 15 wherein the nosepiece securing means further includes means for securing the first plate to the first insert; and means for securing the second plate to the second insert.

17. The discharge cone assembly of claim 9 wherein the nosepiece securing means includes a first plate; a second plate; means for securing the first plate to the nosepiece and the first insert; and means for securing the second plate to the nosepiece and the second insert.

18. The discharge cone assembly of claim 9 wherein the first and second inserts are formed of urethane.

19. The discharge cone assembly of claim 1 wherein the first and second members include means for preventing backwash of the ground material while the mill is located in its discharge portion of the mill rotation.

20. The discharge cone assembly of claim 19 wherein the backwash preventing means comprises a stair step formed in the discharge passageway adjacent the second open end of the first and second members.

21. The discharge cone assembly of claim 1 wherein the mill includes third and fourth discharge assemblies, wherein the second open end of the first member is also in ground material communication with the discharge chamber of the third discharge assembly, and wherein the second open end of the second member is also in ground material communication with the discharge chamber of the fourth discharge assembly.

22. The discharge cone assembly of claim 1 further comprising, in combination: means for providing supplemental radial retaining action for preventing radial movement of the discharge cone assembly in the mill.

23. The discharge cone assembly of claim 22 wherein the mill includes a retainer ring, and wherein the radial retaining action means comprises, in combination: a hook member formed on the nosepiece; and means for attaching the hook member to the retainer ring of the mill.

* * * * *

UNITED STATES PATENT AND TRADEMARK OFFICE

CERTIFICATE OF CORRECTION

PATENT NO. : 4,334,626

DATED : June 15, 1982

INVENTOR(S) : William J. Butler

It is certified that error appears in the above-identified patent and that said Letters Patent are hereby corrected as shown below:

In the heading block on the title page, delete "[73] Assignee: Vermillion Equipment & Supply Co., Inc., Hibbing, Minn." in that the application was never assigned by the inventor.

Signed and Sealed this

*Twenty-fifth* Day of *September 1984*

[SEAL]

*Attest:*

GERALD J. MOSSINGHOFF

*Attesting Officer*

*Commissioner of Patents and Trademarks*